US010208479B2

(12) United States Patent
Sukle et al.

(10) Patent No.: US 10,208,479 B2
(45) Date of Patent: Feb. 19, 2019

(54) COMPOSITE PROFILE STRUCTURE FOR ROOFING APPLICATIONS

(71) Applicant: JOHNS MANVILLE, Denver, CO (US)

(72) Inventors: Zebonie Sukle, Denver, CO (US); Ethan McGraw, Holland, MI (US)

(73) Assignee: Johns Manville, Denver, CO (US)

( * ) Notice: Subject to any disclaimer, the term of this patent is extended or adjusted under 35 U.S.C. 154(b) by 230 days.

(21) Appl. No.: 15/172,389

(22) Filed: Jun. 3, 2016

(65) Prior Publication Data

US 2016/0319547 A1 Nov. 3, 2016

Related U.S. Application Data

(62) Division of application No. 14/045,028, filed on Oct. 3, 2013, now Pat. No. 9,388,578.

(51) Int. Cl.

| | |
|---|---|
| ***E04D 5/14*** | (2006.01) |
| ***E04D 5/10*** | (2006.01) |
| ***E04D 5/06*** | (2006.01) |
| ***E04D 5/12*** | (2006.01) |
| ***E04C 2/26*** | (2006.01) |
| ***E04B 2/00*** | (2006.01) |

(52) U.S. Cl.

CPC ..... *E04D 5/149* (2013.01); *E04C 2/26* (2013.01); *E04C 2/44* (2013.01); *E04D 5/06* (2013.01); *E04D 5/10* (2013.01); *E04D 5/12* (2013.01); *E04D 5/142* (2013.01); *E04D 5/143* (2013.01); *E04D 5/146* (2013.01)

(58) Field of Classification Search

CPC .... E04C 2/44; E04C 2/52–2/526; E04C 2/26; E04C 2003/0473; E04C 3/29; E04D 5/06; E04D 5/10; E04D 5/12; E04D 5/142; E04D 5/143; E04D 5/144–5/147; E04D 5/149; E04D 13/15; B29C 66/836–66/8362; B29C 66/8746; B29C 66/98

See application file for complete search history.

(56) References Cited

U.S. PATENT DOCUMENTS

| | | | |
|---|---|---|---|
| 1,655,164 | A | 1/1928 | Schemmel |
| 3,745,056 | A | 7/1973 | Jackson |
| 3,755,052 | A | 8/1973 | Dressler |
| 3,770,545 | A | 11/1973 | Jackson |
| 3,777,438 | A | 12/1973 | Brown |

(Continued)

OTHER PUBLICATIONS

DYMI Construction, "Radius Curved Standing Seam Panel", video published Mar. 16, 2013, https://www.youtube.com/watch?v=UITPO6B4M98.*

*Primary Examiner* — Matthew P Travers
(74) *Attorney, Agent, or Firm* — Robert D. Touslee

(57) ABSTRACT

Embodiments of the invention provide composite roofing strips that may be attached to a roofing membrane for aesthetic and/or functional purposes and method of attaching the same. According to one embodiment, a composite roofing strip may include a longitudinally extending body having a base and a lateral member extending from the base, and may also include an insert extending partially or fully along the body and coupled therewith. The insert may be formable so as to allow the composite roofing strip to be adjusted to have a desired profile and to maintain the desired profile of the composite roofing strip post adjustment.

6 Claims, 5 Drawing Sheets

(56) References Cited

U.S. PATENT DOCUMENTS

| | | | | |
|---|---|---|---|---|
| 3,906,692 | A | 9/1975 | Boiardi | |
| 4,037,627 | A | 7/1977 | Hurst | |
| 4,260,655 | A | 4/1981 | Zoller | |
| 5,194,312 | A | 3/1993 | Verig | |
| 5,325,647 | A | 7/1994 | Forry et al. | |
| 5,399,393 | A | 3/1995 | Zoller | |
| 5,660,907 | A | 8/1997 | Skalka | |
| 6,230,461 | B1 * | 5/2001 | Piront | E04D 5/06 52/408 |
| 6,554,947 | B2 * | 4/2003 | Pfotenhauer | B29C 66/86521 156/304.1 |
| 7,686,056 | B2 * | 3/2010 | Peterson | B29C 66/1122 156/497 |
| 2002/0074088 | A1 * | 6/2002 | Pfotenhauer | B29C 66/1122 156/391 |
| 2004/0244315 | A1 * | 12/2004 | Rust | E04D 3/366 52/198 |
| 2005/0103437 | A1 * | 5/2005 | Carroll | B29C 65/20 156/304.4 |
| 2005/0183346 | A1 * | 8/2005 | Dudley | F24F 13/222 52/60 |
| 2009/0107073 | A1 * | 4/2009 | Kalkanoglu | B32B 15/08 52/411 |
| 2011/0155319 | A1 * | 6/2011 | Cummings | B29C 65/103 156/308.4 |
| 2011/0155321 | A1 * | 6/2011 | Yang | E04D 15/04 156/334 |
| 2011/0159224 | A1 * | 6/2011 | Yang | B29C 65/5057 428/41.8 |
| 2011/0219715 | A1 * | 9/2011 | Shapiro | E04D 5/12 52/309.1 |
| 2014/0260035 | A1 * | 9/2014 | Boss | E04D 5/06 52/408 |

* cited by examiner

COMPOSITE PROFILE STRUCTURE FOR ROOFING APPLICATIONS

CROSS-REFERENCES TO RELATED APPLICATIONS

This application is a division of prior pending U.S. application Ser. No. 14/045,028 filed Oct. 3, 2013. The entire contents of the above-identified application is herein incorporated by reference for all purposes.

This application is related to U.S. Pat. No. 8,322,113 issued Dec. 4, 2012, titled "Thermoplastic Roofing System," the entire disclosure of which is hereby incorporated by reference, for all purposes, as if fully set forth herein.

BACKGROUND OF THE INVENTION

The present invention generally provide strips or structures that may be attached to a roof, and more specifically provide strips or structures that may be adjusted to have and maintain a desired profile or shape prior to attaching the strips or structures to the roof.

Thermoplastic roofing system provide various advantages to roofing structures, such as excellent weatherability, resistance to puncture and tears, resistance to chemical, grease, and UV light, high reflectivity and/or emissivity, long term strength and flexibility, and the like. These roofing systems are also typically easy to install and are, thus, generally desirable. These roofing structures, however, are general uniform in appearance and may have limited aesthetic appeal. What is needed is a roofing strip that can be attached to roofing systems to provide increased aesthetic appeal and/or serve other functional purposes while being easy to install.

BRIEF SUMMARY OF THE INVENTION

Embodiments of the invention generally provide composite roofing strips that may be coupled with a roof's surface, such as a roofing membrane, for aesthetic or functional purposes. According to one embodiment, a roofing system is provided. The roofing system may include a roofing membrane having a defined contour. A composite roofing strip may be coupled with the roofing membrane for aesthetic or functional purposes, such as to provide an appearance of an architectural seam to the roofing system. The composite roofing strip may include a longitudinally extending body and an insert extending along at least a portion of the body and coupled therewith. The insert may be generally configured to allow a profile of the composite roofing strip to be adjusted so as to correspond to the defined contour of the roofing membrane and to maintain the adjusted profile of the composite roofing strip post adjustment.

The roofing system may also include a second composite roofing strip and the two composite roofing strips may be coupled at adjacent ends via a connection member. The connection member may be inserted within respective apertures of the composite roofing strips to couple the strips together. The composite roofing strip may be shaped by being bent in a first direction (e.g., longitudinally) and/or in a second direction (e.g., laterally) substantially orthogonal to the first direction.

According to another embodiment, a composite roofing strip that is attachable to a roofing membrane is provided. The composite roofing strip may include a longitudinally extending body having a base and a lateral member extending from the base and may also include an insert extending along at least a portion of the body and coupled therewith. The insert may be formable so as to allow the composite roofing strip to be adjusted (e.g., by hand) to have a desired profile and to maintain the desired profile of the composite roofing strip post adjustment.

In some embodiment, the insert may be disposed or encased within or adjacent the base. In other embodiment, the insert may be coupled with or along a bottom surface of the base. The lateral member may include a lumen that extends substantially along the body and/or entirely through the lateral member. In some embodiments, a connector member may be insertable within the lumen to couple adjacent composite roofing strips. In some embodiments, the body may be made of a thermoplastic material while the insert is made of a metallic material.

According to another embodiment, a composite roofing strip that is attachable to a roofing membrane is provided. The composite roofing strip may include a first longitudinally extending member and a second longitudinally extending member coupled with the first longitudinally extending member to form the composite roofing strip. The second longitudinally extending member may be configured to allow a profile of the composite roofing strip to be adjusted according to a desired contour and to maintain the adjusted profile of the composite roofing strip, post adjustment, corresponding to the desired contour. The composite roofing strip may also include a base configured to be attached to the roofing membrane and the second member may be coupled with the base. In some embodiments, the second member may be disposed within the base.

According to another embodiment, a method of attaching a composite roofing strip to a roof is provided. The method may include bending or adjusting (e.g., by hand) at least a portion of a composite roofing strip into a desired shape. The composite roofing strip may be bent or adjusted in a longitudinal direction and/or lateral direction. The composite roofing strip may include a longitudinally extending body and an insert coupled with the body. The insert may be both pliable and sufficiently rigid so as to allow the composite roofing strip to be bent or adjusted into the desired shape and to maintain the composite roofing strip in the desired shape post adjustment. The method may also include attaching the composite roofing strip to a roofing membrane of the roof. The method may further include coupling the composite roofing strip with a second composite roofing strip, such as by inserting a connector member into respective apertures of the respective composite roofing strips.

The composite roofing strip may be bent or adjusted so as to conform to the shape of a roof. In one embodiment, the body is made of a thermoplastic material and the attachment method includes welding the thermoplastic body to the roofing membrane. In another embodiment, the insert includes a metallic member and the method further includes sensing the metallic member with a welding machine to orient the welding machine with respect to the composite roofing strip during the welding process.

BRIEF DESCRIPTION OF THE DRAWINGS

The present invention is described in conjunction with the appended figures.

Figure 1A:
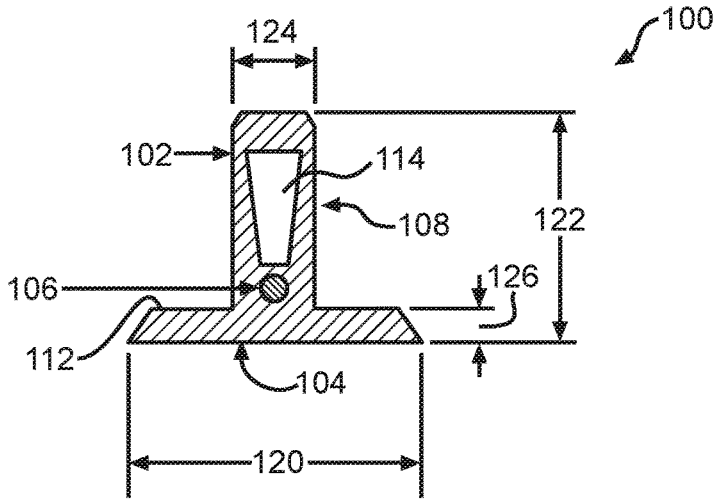
FIGS. 1A and B illustrate cross sectional views of composite roofing strips according to embodiments of the invention.

In the appended figures, similar components and/or features may have the same numerical reference label. Further, various components of the same type may be distinguished by following the reference label by a letter that distinguishes among the similar components and/or features. If only the first numerical reference label is used in the specification, the description is applicable to any one of the similar components and/or features having the same first numerical reference label irrespective of the letter suffix.

DETAILED DESCRIPTION OF THE INVENTION

The ensuing description provides exemplary embodiments only, and is not intended to limit the scope, applicability or configuration of the disclosure. Rather, the ensuing description of the exemplary embodiments will provide those skilled in the art with an enabling description for implementing one or more exemplary embodiments. It being understood that various changes may be made in the function and arrangement of elements without departing from the spirit and scope of the invention as set forth in the appended claims.

The description used herein may use the term flexible, formable, pliable, malleable, and the like to describe a property of a material, such as the described insert. The description may also use other terms, such as rigid (i.e., substantially rigid), firm, and the like to describe another property of the same material or of a different material. It should be realized that such description do not necessarily imply or mean that the material is perfectly or fully flexible or pliable or perfectly or fully rigid or firm. Rather, these descriptions generally describe that the material exhibits some or enough pliability or formability and/or some or enough rigidity or firmness to allow the material to perform the functions described herein. For example, the described insert is generally selected from a material that exhibits both some degree of flexibility or pliability and some degree of rigidity or firmness to allow the insert to be shaped, formed, or bent into one or more shapes or profiles while ensuring that the insert will generally remain in, or otherwise maintain, the shape or profile into which it was shaped, formed, or bent. As described herein, these properties of the insert allow the composite roofing structure to be shaped or formed and remain in the shaped or formed state post adjustment to facilitate placement and/or bonding of the structure with a roof's membrane or surface.

It should further be realized that while the description and/or claims describe the insert and/or composite roofing structure as maintaining or remaining in a shaped or formed state, some variance from the shaped or formed state may occur post adjustment, such as, for example, due to the relaxing and/or resiliency of the material used for the insert and/or the remaining material of the composite roofing structure.

Roofing membranes, such as single ply roofing membranes made of thermoplastic polyolefin (TPO), polyvinyl chloride (PVC), ethylene propylene diene monomer (EPDM), and the like provide various benefits or advantages compared with other roofing material, such as excellent weatherability, resistance to puncture and tears, resistance to chemical, grease, and UV light, high reflectivity and/or emissivity to keep buildings cool and lower power costs, long term strength and flexibility, and the like. These membranes can also provide a watertight seal to underlying structures or building. These membranes are often applied or coupled with roof surfaces by various means, such as adhesion, mechanically fastening, ballasting, and the like. The seams between individual membranes may also be heat welded together. Other structures, such as roofing profiles, can then be attached to the roof membrane via adhesion, heat welding, mechanically fastening, and the like.

Embodiments of the invention provide composite roofing structures and systems that may be attached to roofing membranes or other roofing surfaces, and methods for making and attaching the same to roofs. The composite roofing structures may be attached to the roofing membranes or structure for structural and/or aesthetic purposes. Because the composite roofing structures are attached to the roof, these structures need to conform to the roof's surface. Conformance may require that the composite roofing structure be bent, formed, shaped, or otherwise adjusted in one or more directions. For example, the roof's surface may have various vertical and/or horizontal contours or profiles that the composite roofing structure must conform to. To facilitate conformance, the composite roofing structure may be made of a flexible or pliable material, such as an extruded plastic, a metal, and the like so as to allow the structure to be bent, shaped, or formed in conformance with the roof's surface.

To further facilitate conformance, the composite roofing structure may include two types of materials coupled together, where one of the materials exhibits a higher degree of rigidity or firmness so as to hold, secure, or otherwise maintain the composite roofing structure in a substantially bent shape or configuration. In this manner, the composite roofing structure can be bent, formed, or shaped to conform to a roof's surface and maintained, or otherwise remain, in the formed or shaped state or configuration post adjustment. This may allow an installer, by hand, to form the roofing structure into a desired or defined shape or state and to subsequently attach the structure to the roof surface without requiring the installer to hold or secure the roofing structure in the desired or defined shape or state. Further, only a single installer may be required since the roofing structure is able to remain in the desire or defined shape or state post adjustment without being held or secured in place.

According to one embodiment, the material having or exhibiting the increased rigidity or firmness may be fully or partially disposed within the other material. In another embodiment, this material (i.e., having or exhibiting increased rigidity or firmness) may also have or exhibit one or more electrical properties, such as decreased resistance and/or various magnetic properties. These additional properties may allow the electricity to be conducted through or along the roofing structure and/or allow other operational functionalities to be performed, such as positioning of a heat welding machine. These and other aspects of the composite roofing structure will be more evident with references to the figures described below.

Figure 1B:
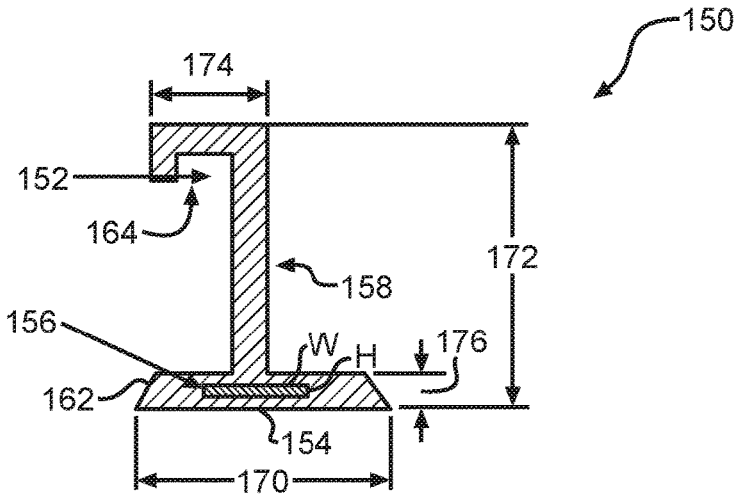
FIG. 1C illustrates a perspective view of a connection member that may be used to connect adjacent composite roofing strips according to an embodiment of the invention.
Figure 1C:
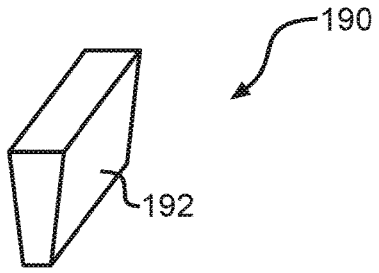

With reference to FIGS. 1A-C, illustrated are embodiments of composite roofing structures (also referred to herein as a composite roofing strip) and an insert that may be used to couple adjacent composite roofing structures together. Specifically, FIG. 1A shows a cross sectional view of a composite roofing strip 100. Composite roofing strip 100 includes a body 102 that extends longitudinally as shown in some of the other figures. Body 102 defines a geometric shape of composite roofing strip 102, which shape may be for aesthetic or functional purposes. In one embodiment, the geometric shape of composite roofing strip 102 provides the appearance of an architectural seam profile to the roofing system. In some embodiments, body 102 includes or is made of a flexible material that may include a thermoplastic such as TPO, PVC, TPV, and the like. The flexible material allows body 102 to be bent, formed, shaped, or otherwise adjusted to conform to the surface of a roof or other structure as described herein. The material of body 102 generally exhibits a high degree of resiliency, especially with respect to deformation by bending. Thus, body 102 will generally return to an original shape (e.g., a roughly straight shape) after being bent to conform to the roof's surface or into another shape.

Body 102 includes a base 104 and a lateral member 108 that extends substantially orthogonally from base 104. A rear surface of base 104 is configured to contact the roofing membrane or other roofing surface and be coupled therewith. In some embodiments, coupling base 104 with the roof's surface includes heat welding base 104 to a roofing membrane. Base 104 may also be mechanically attached and/or adhered to the roof's surface. Base 104 may include a pair of flanges 112 that extend from a central region or portion of base 104 so that base 104 includes an overall width 120 of about ½ to 6 inches. In some embodiments, composite roofing strip 100 is attached to the roof's surface by heat welding one or both flanges 112 to a thermoplastic roof membrane, such as a TPO, PVC, TPV, and the like membrane. Flanges 112 may have chamfered or rounded edge portions.

Lateral member 108 may extend substantially orthogonally from the central portion or region of base 104. Upper edge portion of lateral member 108 may be chamfered or rounded. Lateral member 108 may also have a lumen 114 that extends partially or fully along and through lateral member 108. In one embodiment, lumen 114 extends longitudinally into lateral member 108 to a defined distance so as to form an aperture or pocket at one end of composite roofing strip 100. An opposite end of composite roofing strip 100 may include a similar aperture or pocket. In another embodiment, lumen 114 extends longitudinally through lateral member 108 so as to form a channel entirely through lateral member 108. Lumen 114 may reduce the overall weight of composite roofing strip 100 and/or allow various wiring, cables, or other items to be run through lumen 114 and along composite roofing strip 100. Lumen 114 may be sized with respect to lateral member 108 so that the walls of lateral member 108 adjacent lumen 114 are about 0.10 inches thick or thicker.

In a specific embodiment, lumen 114 is used to couple adjacent composite roofing strips 100 by accepting a connector or connection member 190 shown in FIG. 10. For example, lumen 114 may have a defined geometric shape, such as the triangular shape shown in FIG. 1A. Connection member 190 may have a corresponding shape so as to allow connection member 190 to be inserted into respective lumens 114 of adjacent composite roofing strips 100. Connection member 190 has a body 192 having a longitudinal length of between about 1 and 6 inches. In one embodiment, approximately half of connection member 190 is inserted into each lumen 114 of respective composite roofing strips 100. Connection member 190 may be sized slightly larger than lumen 114 to provide a press fit between composite roofing strip 100 and connection member 190. In other embodiments, connection member 190 includes ribs, detents, or other features that securingly couple connection member 190 within lumen 114. Lumen 114 may have corresponding connection features (e.g., rib or detent impressions, and the like) that allow connection member 190 to snap fit together with lumen 114.

Composite roofing strip 100 also includes an insert 106 that extends longitudinally along at least a portion of body 102 and is coupled therewith. In one embodiment, insert 106 extends along the entire length of body 102 from one end of composite roofing strip 100 to an opposite end. In another embodiment, insert 106 extends only along a portion of composite roofing strip 100, such as along about 50-90% of body 102, and/or is centered longitudinally within composite roofing strip 100. Insert 100 may be disposed within body 102 so that insert 106 is entirely encased or surrounded by the material of body 102. In other embodiments, insert 106 may be only partially disposed within body 102 such as by being coupled with a bottom surface of base 104. Insert 106 may be positioned within or immediately adjacent base 104 below lumen 114 as shown in FIG. 1A, or may be positioned within lateral member 108, flanges 112, or anywhere else within body 102. In some embodiments, insert 106 may have a substantially circular cross section, as shown in FIG. 1A. In other embodiments, insert 106 may have an oval, semi-circular, square, rectangular, and the like cross section.

Like body 102, insert 106 may also be made of a flexible material so as to allow insert 106 to be bent, formed, shaped, or otherwise adjusted along with body 102 to conform to the surface of a roof or other structure. Unlike body 102, however, insert 106 may have increased rigidity or firmness so as to allow body 102 and composite roofing strip 100 to maintain, or otherwise remain, in a formed or adjusted shape post adjustment. In other words, insert 106 may not exhibit as high of a resiliency as body 102 and/or may plastically deform when subjected to bending deformation and as such, may resist returning to an original or pre-adjustment shape, such as being roughly straight. Insert 106, thus, may act as a forming rod to allow the shape of composite roofing strip 100 to be bent, adjusted, or otherwise formed, and to hold or secure composite roofing strip 100 in the adjusted shape post adjustment. In some embodiments, insert 106 includes a modulus of elasticity of between about $0.2\times10^9$ N/m$^2$ and $200\times10^9$ N/m$^2$ (i.e., 0.2 to 200 GPa). This allows insert 106 to act as a forming rod and exhibit the flexibility and firmness characteristics described herein. By describing that insert 106 maintains, holds, or secures composite roofing strip 100 in the adjusted or formed shape, it should be realized that some resiliency of composite roofing strip, however small, may be exhibited. The amount of resiliency exhibited, however, will often be negligible so that the adjusted or formed shape of composite roofing strip 100 is substantially maintained.

Insert 106 is generally made of a material different than body 102. In one embodiment, insert 106 is made of a metal material, which may include aluminum, iron, copper, steel, and the like. In another embodiment, insert 106 is made of a firm polymer material including PVC, TPO, TPV, and the like. When insert 106 includes a metallic material, the metallic insert 106 may be magnetic. The magnetic insert 106 may be used as a location detecting device such as for guiding a welding device that welds composite roofing strip 100 to the roofing membrane, or may be used for any other purpose. A metallic insert 106 may also be used to route electricity or electrical or communication signals along composite roofing strip 100.

FIG. 1B shows another embodiment of a composite roofing strip 150. Like, the embodiment described in FIG. 1A, composite roofing strip 150 includes a body 152 having a base 154 with flanges 162 and lateral member 158 extending substantially orthogonally from a central portion of base 154. Body 152 may have a width 170 similar to that described for composite roofing strip 100. Instead of lumen 114, however, composite roofing strip 150 includes a hooked portion 164 near a top end of lateral member 158. Hooked portion 164 may serve as a track that guides a welding machines locating arm, or may serve any other aesthetic or functional purpose. Composite roofing strip 150 also includes an insert 156, which is shown as a rectangular member disposed within base 154. Insert 156 may have a width W of about 0.125 inches and a height H of about 0.025 inches. In other embodiments, insert 156 may be a rectangular, square, or other geometric shape.

Like insert 106, insert 156 may extend partially or fully through body 152 or base 154. Insert 156 may similarly be made of a metal or stiff polymer material and/or may be magnetic or conductive as described previously. Insert 156 functions as a forming strip by exhibiting the flexibility and rigidity or stiffness previously described to allow composite roofing strip 150 to be bent, shaped, or otherwise adjusted into a desired shape and to maintain, hold, or secure composite roofing strip 150 in the shaped or adjusted shape or state post adjustment. Insert 156 may provide increased ability to hold or maintain composite roofing strip 150 in the shaped or adjusted state compared to insert 106, especially when adjusted in a lateral direction due to increased plastic deformation of the edges portions of insert 156.

In some embodiments, the composite roofing strips, 100 and 150, could be manufactured by pulling (e.g., via a machine) inserts, 106 and 156, at the same time that the respective bodies, 100 and 150, are being extruded. In another method, the inserts, 106 and 156, could be extruded simultaneously with the bodies, 100 and 150. These manufacturing methods may result in the inserts being fully or partially disposed within the bodies and positioned within or near the base or another portion of the strips. The composite roofing strips, 100 and 150, may be coupled with a roofing membrane either onsite or prior to be coupled with a roof to provide a roofing system. The roofing system may include adjacent composite roofing strips that are coupled via connection members, such as connector 190. The composite roofing strips may also be bent, shaped, or adjusted in more than one direction. For example, the strips may be bent both longitudinally and laterally to accommodate a surface profile of the roof and/or for other aesthetic or functional reasons.

Figure 2:
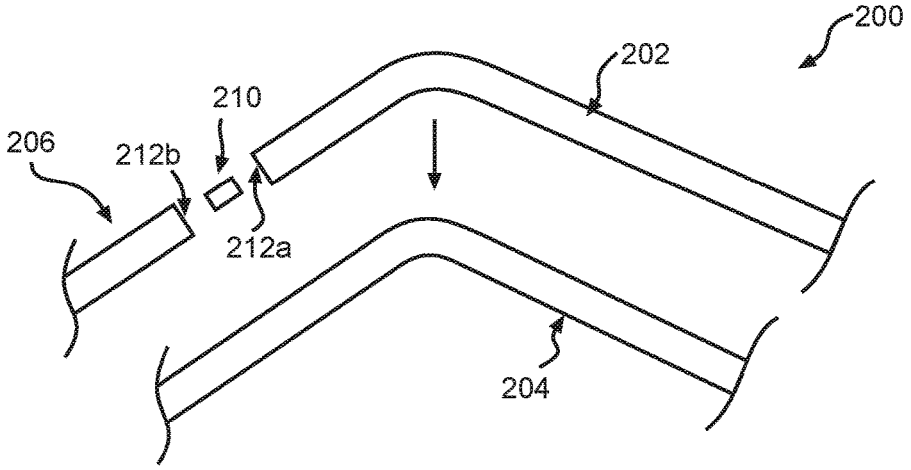
FIG. 2 illustrates a side view of a composite roofing strip being adjusted in a longitudinal direction so as to accommodate a roof's surface according to an embodiment of the invention.

Referring now to FIG. 2, illustrated is a composite roofing strip 200 being bent longitudinally so as to accommodate the profile of roof surface 204. Specifically, one end or portion of body 202 is bent to correspond to a curve in roof surface 204. The insert (not shown) of body 202, which may be fully or partially disposed within body 202, allows body 202 to be bent into shape and subsequently maintains the bent shape of body 202 post adjustment. This allows an installer to bend body 202 by hand and attach (e.g., via heat welding and the like) body 202 to roof surface 204 without requiring the installer to hold or secure body 202 in the bent configuration. As also shown in FIG. 2, a second composite roofing strip 206 can be coupled with an end of strip 200 by inserting a connection member 210 within respective lumens or apertures, 212*b* and 212*a*, of the strips. The ends of the composite roofing strips, 200 and 206, may abut each other to provide a nearly seamless transition from one strip to the next.

Figure 3:
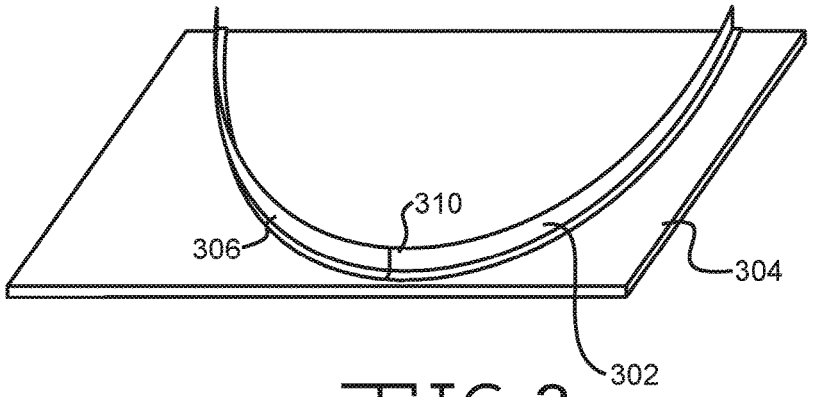
FIG. 3 illustrates a perspective view of a composite roofing strip being adjusted in a lateral direction atop a roofing membrane according to an embodiment of the invention.

FIG. 3 illustrates a composite roofing strip 302 being bent or curved laterally atop a roofing membrane 304 and attached thereto. Strip 302 may be bent or curved in such a manner for aesthetic and/or functional purposes, such as to provide a desired design atop the roof. The insert (not shown) of strip 302 allows strip 302 to be bent or curved laterally and subsequently maintains the bent or curved shape or state of strip 302 post adjustment. As described previously, this allows an installer to bend or curve strip 302 by hand and to attach strip 302 to roof membrane 304 without requiring the installer to hold or secure strip 302 in the bent or curved configuration. FIG. 3 also shows a second composite roofing strip 306 abutting and coupled with strip 302 at seam 310. The strips, 302 and 306, may be attached as described herein so that seam 310 provides a smooth transition between the strips. In some embodiments, the strips may be bent, shaped, curved, or adjusted in both the longitudinal and lateral directions as shown in FIGS. 2 and 3 to accommodate various roofing surfaces and/or for other aesthetic or functional reasons.

Figure 4:
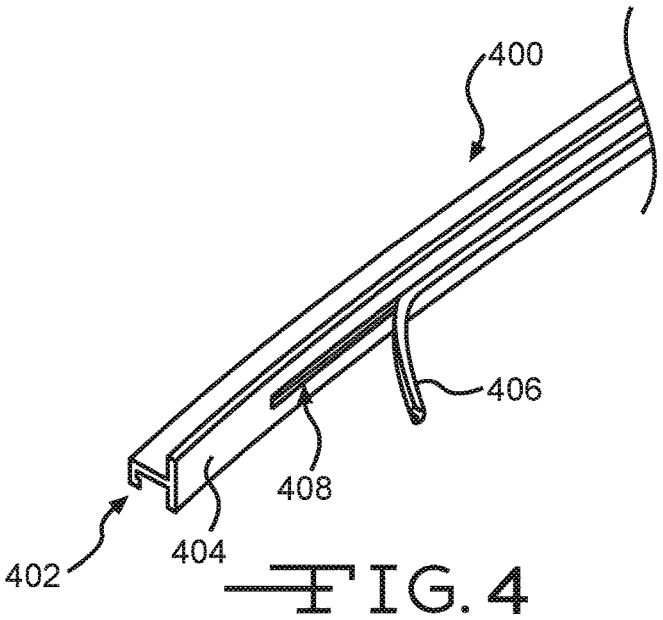
FIG. 4 illustrates a perspective view of a composite roofing strip according to another embodiment of the invention.

Referring now to FIG. 4, illustrated is another embodiment of a composite roofing strip 400 having a body 402 configured similar to composite roofing strip 150 of FIG. 1B. Composite roofing strip 400, however, includes a slot or channel 408 on the bottom surface of base 404 within which insert 406 is disposed. Insert 406 is similar to those previously described exhibiting both some degree of flexibility and firmness or rigidity to allow strip 400 to be adjusted and to maintain the adjusted shape of strip 400 post adjustment. Unlike the previously described inserts, however, insert 406 is not fully disposed within body 402, but rather partially disposed within body 402. Insert 406 may extend partially or fully along the longitudinal length of body 402. In some embodiments, insert 406 may be removed from channel 408 and replaced with another insert. This may allow inserts of different rigidity or firmness to be used so as to accommodate various needs or conditions of the roof surface. In another embodiment, two inserts are partially or fully disposed within body 402, such as by having two inserts disposed partially or fully within each of the flanges of body 402.

Figure 5:
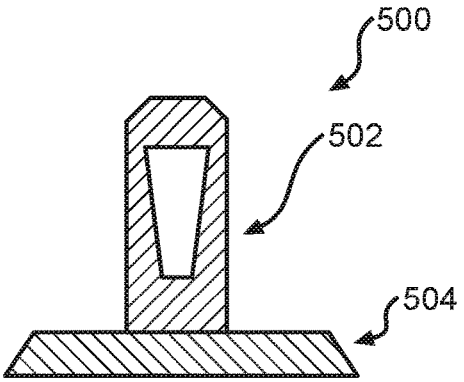
FIG. 5 illustrates a cross sectional view of a composite roofing strip according to another embodiment of the invention.

Referring now to FIG. 5, illustrated is another embodiment of a composite roofing strip 500. Strip 500 is configured similar to composite roofing strip 100 of FIG. 1A including a base, lateral member, and lumen. Rather than having an insert disposed within the body, however, the base 504 and lateral member 502 of strip 500 are made of dissimilar materials. Specifically, either base 504 or lateral member 502 is made of a material exhibiting the flexible and firm/rigid characteristics described above. This material may include a metal or stiff or rigid polymer as previously described. Thus, either base 504 or lateral member 502 functions in a similar capacity to the inserts previously described to allow strip 500 to be bent, curved, shaped, or adjusted and to maintain the adjusted shape post adjustment. In a specific embodiment, base 504 functions in a capacity similar to the previously described inserts and lateral member 502 is made of a relatively flexible and resilient material. In some embodiments, strip 500 may include a thermoplastic coating, which may be a PVC, TPO, and/or other material coating.

Having described several embodiments of composite roofing strips, a method of attaching a composite roofing strip to a roof will now be described. The method may include bending at least a portion of a composite roofing strip into a desired shape. The composite roofing strip may be bent in a longitudinal direction and/or lateral direction such as to conform to a shape of the roof and/or for other aesthetic or functional purposes. As described herein, the composite roofing strip may include a longitudinally extending body and a pliable insert coupled with the body, the pliable insert being sufficiently rigid so as to maintain the composite roofing strip in the desired shape. The method may also include attaching the composite roofing strip to a roofing membrane of the roof. In one embodiment, the body includes or is made of a thermoplastic material and the composite roofing strip is attached to the roofing membrane by heat welding the thermoplastic body to the roofing membrane. Other methods of attaching the body to the roofing membrane may include adhesively bonding the body to the roofing membrane and/or mechanically fastening the body to the roofing membrane.

In one embodiment, the insert includes or is made of a metallic member and the method further includes sensing the metallic member with a welding machine to orient the welding machine with respect to the composite roofing strip during the welding process. The method may further include coupling the composite roofing strip to a second composite roofing strip to such as by inserting a connector member into respective apertures of the composite roofing strips.

Figure 6:
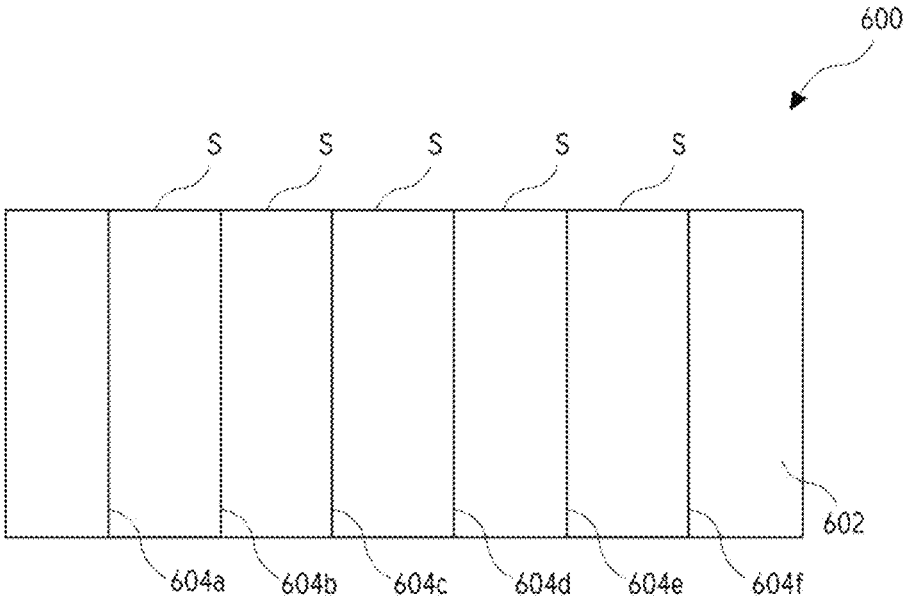
FIG. 6 illustrates a top view of a roofing system showing a plurality of composite roofing strips aligned and coupled atop a roofing membrane according to an embodiment of the invention.

Referring now to FIG. 6, illustrated is a roof surface 600 including a roofing membrane 602 and a plurality of composite roofing strips 604*a-f* coupled with roofing membrane 602. In one embodiment, roofing membrane 602 is a single ply roofing membrane made of thermoplastic polyolefin (TPO), polyvinyl chloride (PVC), ethylene propylene diene monomer (EPDM), and the like. Composite roofing strips 604*a-f* are arranged in a parallel design and coupled with the outer surface of roofing membrane 602. Composite roofing strips 604*a-f* may be coupled with roofing membrane 602 via heat welding, adhesively bonding, mechanically fastening, and the like. Composite roofing strips 604*a-f* may be arranged atop roofing membrane 602 with a predetermined spacing S between each of the roofing strips. Spacing S may be determined by measuring a total width of roofing membrane 602 and dividing the width by the total number of composite roofing strip 604*a-f* to be aligned and coupled with roofing membrane 602. Composite roofing strips 604*a-f* are coupled with roofing membrane 602 to provide aesthetic and/or structural benefits. For example, composite roofing strips 604*a-f* may provide the appearance of architectural seams to roofing membrane 602 to provide a visually appealing roofing system. Composite roofing strips 604*a-f* may also provide additional mass and/or rigidity to roofing membrane 602, such as to provide increased resistance against uplift forces. Composite roofing strips 604*a-f* may also be arranged atop roofing membrane 602 in other patterns, such as in a herringbone pattern and the like.

Figure 7:
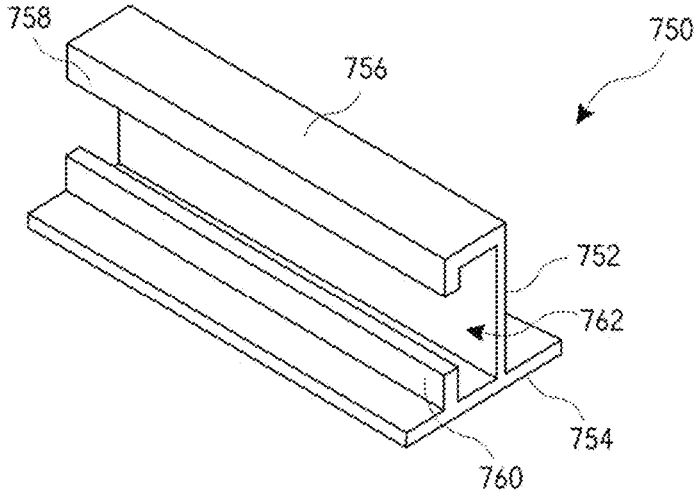
FIG. 7 illustrates a perspective view of a composite roofing strip according to an embodiment of the invention.

FIG. 7 shows another embodiment of a composite roofing strip 750. Like, the embodiment described in FIG. 1B, composite roofing strip 750 includes a body 752 having a base 754 with laterally extending flanges. Body 752 may have a width similar to the embodiments previously described. Roofing strip 750 also includes a hooked top member 756 positioned at a top end of body 752. Hooked top member 756 includes a downward extending flange 758 while base 754 includes an upward extending flange 760. The upward and downward extending flanges, 760 and 758 respectively, form a C-shaped channel 762. In some embodiments, a spacing between an inner surface of body 752 and the upward and downward extending flanges, 760 and 758 respectively, may be approximately the same such that the upward extending flange 760 is positioned immediately below the downward extending flange 758. In other embodiments, this spacing may be varied. Similar to the embodiment of FIG. 1B, the hooked top member 756 may function as a track that guides a welding machines locating arm, or may serve any other aesthetic or functional purpose.

Composite roofing strip 750 may also include an insert (not shown) disposed within base 754 and/or body 752. The insert may extend partially or fully through body 752 or base 754. The insert may be made of a metal or stiff polymer material and/or may be magnetic or conductive as previously described and may function as a forming strip by exhibiting the flexibility, rigidity, and/or stiffness previously described to allow composite roofing strip 750 to be bent, shaped, or otherwise adjusted into a desired shape and maintained or secured in the adjusted shape.

Figure 8:
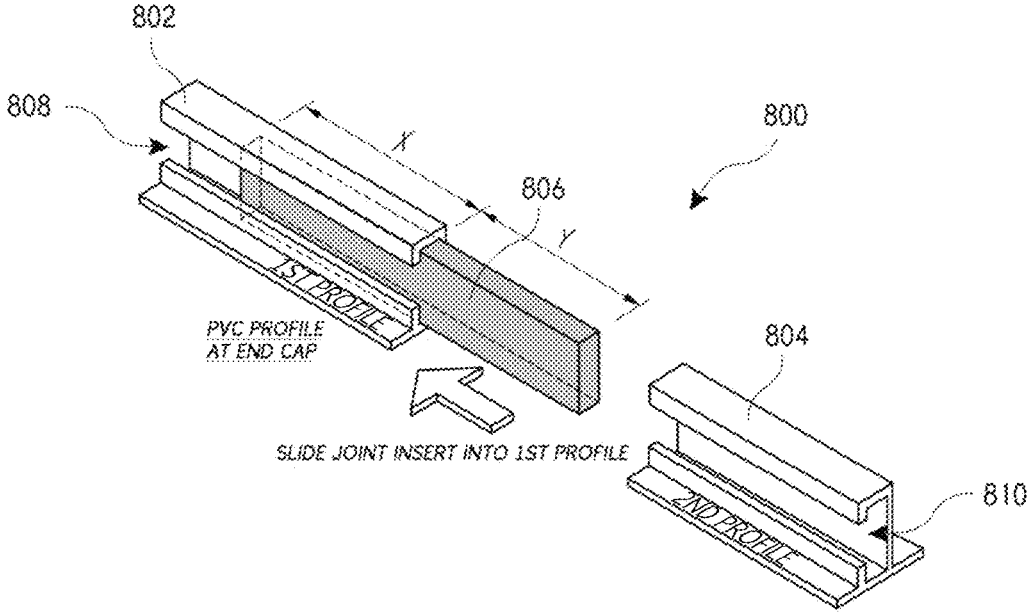
FIG. 8 illustrates two composite roofing strips being coupled together via a coupling member according to an embodiment of the invention.

FIG. 8 shows a first composite roofing strip 802 being coupled with a second composite roofing strip 804. The first and second composite roofing strips, 802 and 804, are configured according to the embodiment described in FIG. 7 having the upward and downward extending flanges that form C-shaped channels, 808 and 810 respectively. To couple the first and second composite roofing strips, 802 and 804, a coupling member 806 is inserted within the C-shaped channel 808 of the first composite roofing strip 802. The second composite roofing strip 804 may then be coupled with the first composite roofing strip 802 by sliding the coupling member 806 within the C-shaped channel 810 of the second composite roofing strip 804. The upward and downward extending flanges, 808 and 810, function to maintain or secure the coupling member 806 within the C-shaped channels. In many embodiments, the coupling member 806 has a configuration that corresponds to the C-shaped channels, 808 and 810, of the first and second composite roofing strips, 802 and 804. This allows the coupling member 806 to be easily inserted within the composite strips' C-shaped channels.

In some embodiments, the coupling member 806 is square or rectangular in shape and approximately 6 inches long. The coupling member 806 may be inserted within the respective C-shaped channels so that approximately half of the coupling member 806 is disposed within each channel. It should be realized that other geometries and/or sizes may be used for the coupling member 806 as desired. Although not shown, in some embodiments, the coupling member 806 may have one or more lumens that extend partially or fully longitudinally through the coupling member's body.

Having described several embodiments, it will be recognized by those of skill in the art that various modifications, alternative constructions, and equivalents may be used without departing from the spirit of the invention. Additionally, a number of well-known processes and elements have not been described in order to avoid unnecessarily obscuring the present invention. Accordingly, the above description should not be taken as limiting the scope of the invention.

Where a range of values is provided, it is understood that each intervening value, to the tenth of the unit of the lower limit unless the context clearly dictates otherwise, between the upper and lower limits of that range is also specifically disclosed. Each smaller range between any stated value or intervening value in a stated range and any other stated or intervening value in that stated range is encompassed. The upper and lower limits of these smaller ranges may independently be included or excluded in the range, and each range where either, neither or both limits are included in the smaller ranges is also encompassed within the invention, subject to any specifically excluded limit in the stated range. Where the stated range includes one or both of the limits, ranges excluding either or both of those included limits are also included.

As used herein and in the appended claims, the singular forms "a", "an", and "the" include plural referents unless the context clearly dictates otherwise. Thus, for example, reference to "a process" includes a plurality of such processes and reference to "the device" includes reference to one or more devices and equivalents thereof known to those skilled in the art, and so forth.

Also, the words "comprise," "comprising," "include," "including," and "includes" when used in this specification and in the following claims are intended to specify the presence of stated features, integers, components, or steps, but they do not preclude the presence or addition of one or more other features, integers, components, steps, acts, or groups.

What is claimed is:

1. A method of attaching a composite roofing strip to a roof comprising:

providing a composite roofing strip comprising:

a longitudinally extending body comprising a base and a lateral member extending from a top surface of the base so as to be substantially orthogonal to the base, wherein the body comprises a first material; and a single insert coupled with the base of the longitudinally extending body, the single insert extending along at least a portion of the body and the single insert being the sole insert included within the composite roofing strip, wherein a width and a thickness of the single insert is less than a distance that the lateral member extends from the top surface of the base, and wherein the single insert comprises a second material having a modulus of elasticity that is different than the first material;

positioning the base of the longitudinally extending body atop a roof membrane of the roof;

bending at least a portion of the composite roofing strip into a desired shape, wherein the single insert is sufficiently rigid so as to maintain the composite roofing strip in the desired shape; and attaching the base of the longitudinally extending body to the roofing membrane to attach the composite roofing strip to the roof.

2. The method of claim 1, wherein the composite roofing strip is bent to conform to the shape of the roof.

3. The method of claim 1, wherein the longitudinally extending body comprises a thermoplastic material and wherein attaching the base of the longitudinally extending body to the roofing membrane comprises welding the thermoplastic material to the roofing membrane.

4. The method of claim 1, wherein the single insert comprises a metallic member and the method further comprises sensing the metallic member with a welding machine so as to orient the welding machine with respect to the composite roofing strip during a welding process.

5. The method of claim 1, wherein the composite roofing strip is a first composite roofing strip and the method further comprises coupling a second composite roofing strip to the first composite roofing strip.

6. The method of claim 5, wherein coupling the second composite roofing strip to the first composite roofing strip comprises inserting a connector member into respective apertures of the first and second composite roofing strips.

* * * * *